United States Patent [19]

McDermott

[11] Patent Number: 4,681,032

[45] Date of Patent: Jul. 21, 1987

[54] BUNDLING DEVICE

[76] Inventor: Eve C. McDermott, 200 E. 48th St., New York, N.Y. 10028

[21] Appl. No.: 723,619

[22] Filed: Apr. 15, 1985

[51] Int. Cl.[4] ..... B65B 13/00

[52] U.S. Cl. ..... 100/34; 24/16 PB; 53/390; 53/592

[58] Field of Search ..... 100/1, 2, 8, 10, 34; 206/499; 211/50; 140/93 A, 49, 53, 38, 57; 53/390, 399, 590, 592; 40/305; 283/36, 81; 24/16 R, 16 PB

[56] References Cited

U.S. PATENT DOCUMENTS

| | | | |
|---|---|---|---|
| 1,373,939 | 4/1921 | Bates | 140/93 A |
| 2,004,924 | 6/1935 | Brown | 40/305 |
| 2,364,518 | 12/1944 | Clouser . | |
| 2,575,048 | 11/1951 | Dankert . | |
| 2,636,432 | 4/1953 | Sherer . | |
| 2,639,037 | 5/1953 | Friend . | |
| 2,744,461 | 5/1956 | Genco . | |
| 2,747,498 | 5/1956 | Bellar . | |
| 2,781,621 | 2/1957 | Wilson | 53/592 |
| 2,979,794 | 4/1961 | De Bartolo . | |
| 3,038,403 | 6/1962 | Orelind . | |
| 3,145,646 | 8/1964 | Levy | 100/34 |
| 3,147,522 | 9/1964 | Schumm | 24/16 PB |
| 3,217,461 | 11/1965 | Wheelock | 100/34 X |
| 3,247,782 | 4/1966 | Foster | 100/34 |
| 3,339,246 | 9/1967 | Geisinger . | |
| 3,357,344 | 12/1967 | Pate . | |
| 3,368,247 | 2/1968 | Orban . | |
| 3,382,794 | 5/1968 | Lindholm et al. . | |
| 3,457,598 | 7/1969 | Mariani . | |
| 3,486,201 | 12/1969 | Bourne . | |
| 3,491,681 | 1/1970 | Saro, Jr. et al. . | |
| 3,498,214 | 3/1970 | Bailey . | |
| 3,537,146 | 11/1970 | Caveney . | |
| 3,542,321 | 11/1970 | Kahabka . | |
| 3,588,962 | 6/1971 | Feldberg . | |
| 3,627,300 | 12/1971 | Caveney et al. . | |
| 3,654,669 | 4/1972 | Fulton . | |
| 3,660,869 | 5/1972 | Caveney et al. . | |
| 3,731,347 | 5/1973 | Caveney et al. . | |
| 3,739,714 | 6/1973 | Howard . | |
| 3,757,936 | 9/1973 | Lindegren | 24/16 PB X |
| 3,766,608 | 10/1973 | Fay . | |
| 3,780,854 | 12/1973 | Ruppenthal . | |
| 3,780,921 | 12/1973 | Harp | 225/2 |
| 3,850,092 | 11/1974 | Montgomery . | |
| 3,891,012 | 6/1975 | Bakermans | 100/8 X |
| 3,903,789 | 9/1975 | Hurley . | |
| 3,912,047 | 10/1975 | Chun et al. . | |
| 3,933,088 | 1/1976 | Pessagno . | |
| 3,952,876 | 4/1976 | Price . | |
| 3,964,381 | 6/1976 | Coenen . | |
| 3,983,799 | 10/1976 | Paul . | |
| 4,084,495 | 4/1978 | Paul . | |
| 4,104,960 | 8/1978 | Kuhnen . | |
| 4,137,606 | 2/1979 | Wood . | |
| 4,150,612 | 4/1979 | Kessler . | |
| 4,154,159 | 5/1979 | Ortega . | |
| 4,167,903 | 9/1979 | Lasher . | |
| 4,183,119 | 1/1980 | Stewart et al. . | |
| 4,193,340 | 3/1980 | Finn . | |
| 4,272,870 | 6/1981 | McCormick . | |
| 4,395,941 | 8/1983 | Metzger . | |
| 4,470,173 | 9/1984 | Adamson . | |
| 4,477,950 | 10/1984 | Cisek et al. . | |
| 4,523,776 | 6/1985 | Barber | 283/81 X |

*Primary Examiner*—Billy J. Wilhite

*Attorney, Agent, or Firm*—Hoffmann, Dilworth, Barrese & Baron

[57] ABSTRACT

A bundling device is disclosed for providing bundle units of waste paper or other articles. The device comprises (a) a quantity of serially dispensable, flexible, elongated ties of a length sufficient to encompass a stack of articles to be bundled, (b) means for maintaining the ties in a predetermined position relative to said stack of articles and, optionally, (c) an article-receiving receptacle with means (b) being attached to the base of the receptacle at a preselected site thereon and, optionally when said article-receiving receptacle (c) is provided, (d) means for attaching the terminal portions of ties (a) to a preselected site on the walls of the receptacle.

47 Claims, 15 Drawing Figures

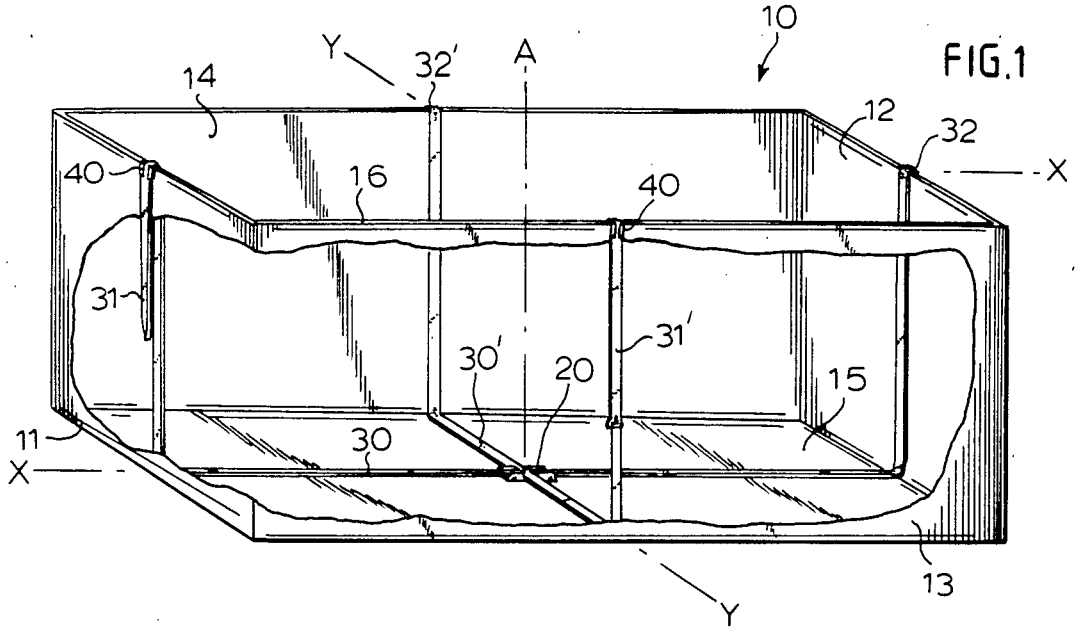
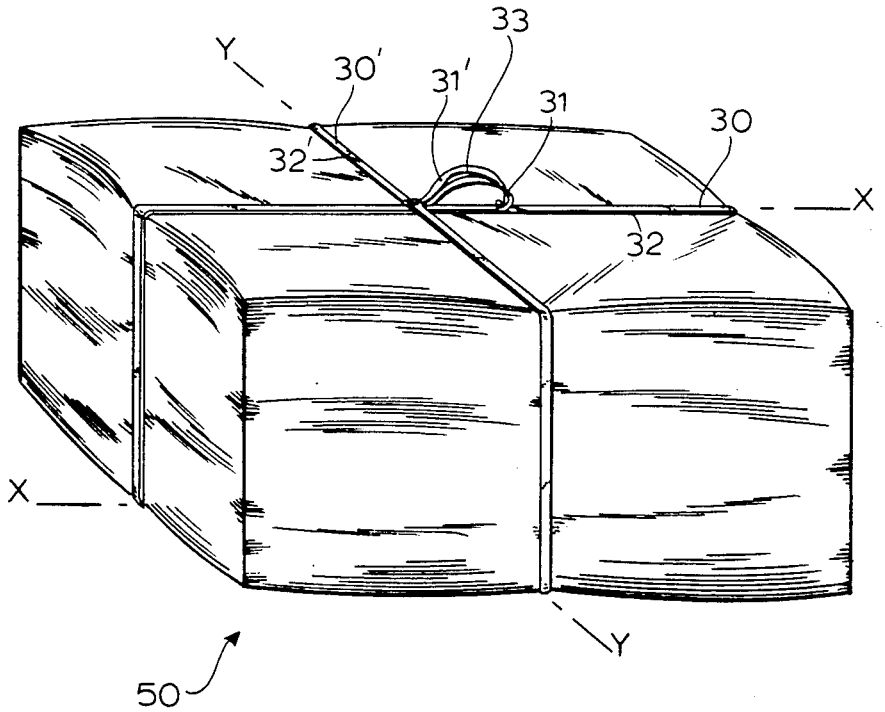
FIG. 2

FIG.7
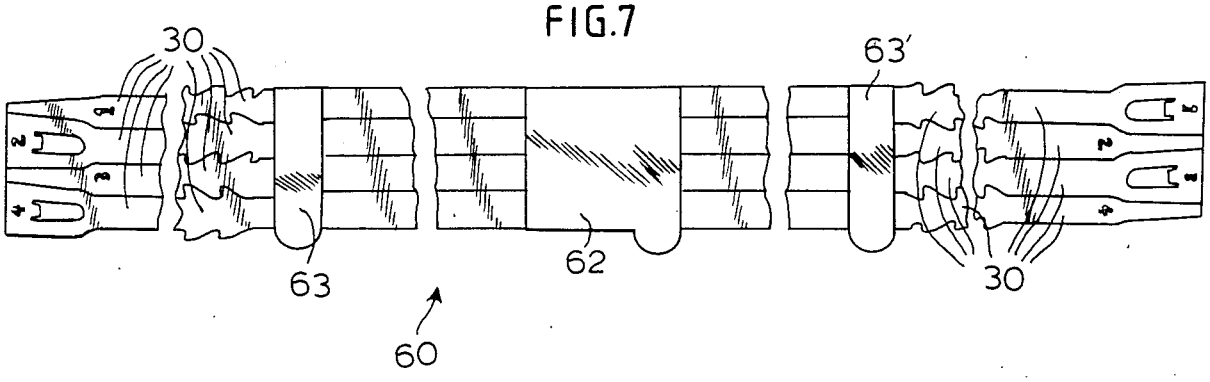
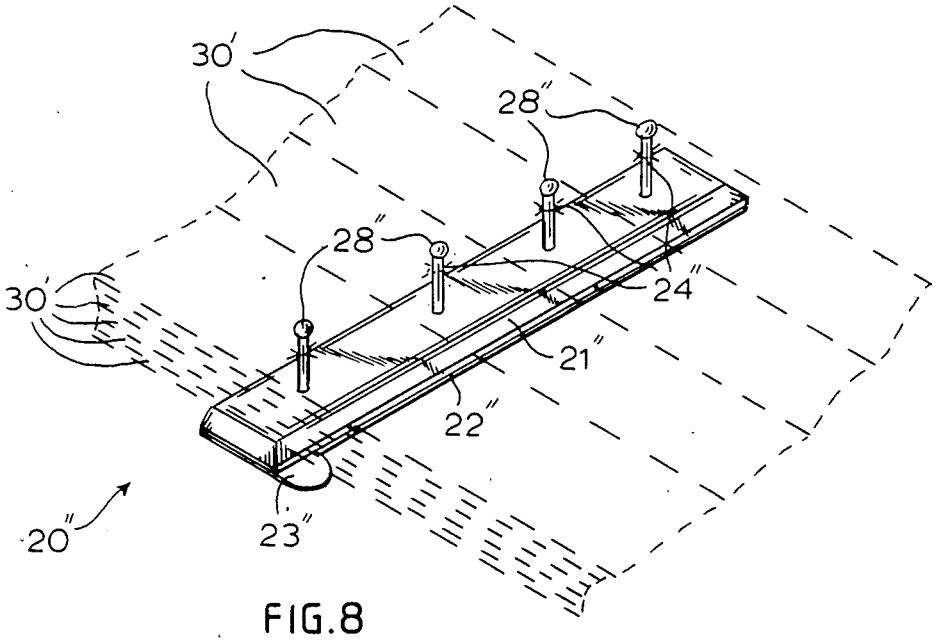
FIG.8

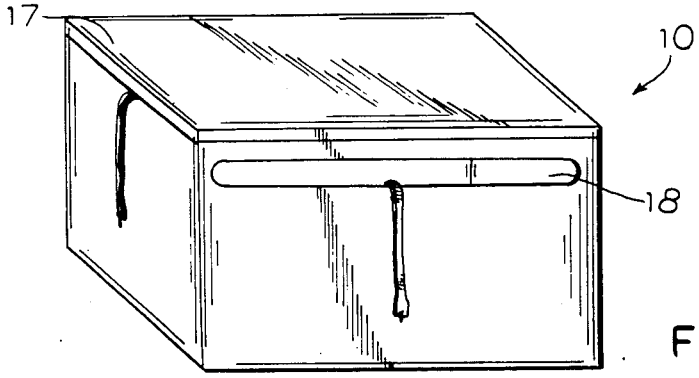
FIG.11
FIG.12
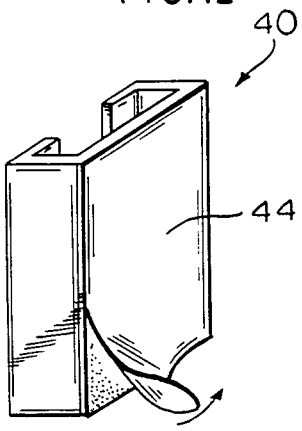
FIG.13
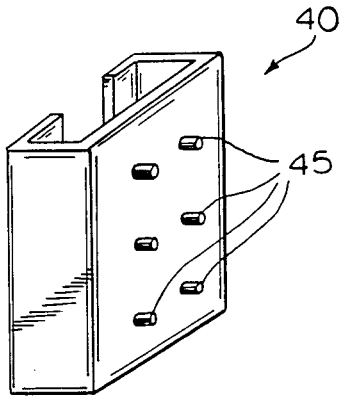
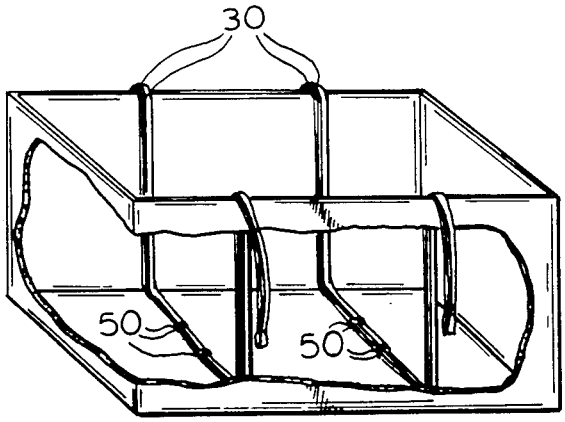
FIG.14

BUNDLING DEVICE

BACKGROUND OF THE INVENTION

This invention belongs to the field of bale and package ties. More particularly, it relates to a bundling device featuring a plurality of serially dispensable, self-locking bale or package ties especially suited for providing recyclable refuse, e.g., old newspapers, magazines, paperboard cartons, and the like ("waste paper"), in the form of conveniently disposable bundle units.

Increasingly in recent years, it has become a common practice to segregate waste paper from the general refuse and to tie the former into bundles for pick-up and delivery to a recycling center. Even where this practice is not compelled by local statute, regulation or ordinance, it is frequently done on a voluntary basis. The benefits are several fold: for example, the potential for atmospheric pollution arising from the incineration of waste paper is lessened, an economically valuable resource which would otherwise be irretrievably lost is conserved and a saving of energy results from manufacturing with recycled product compared with that required to manufacture from anew.

Self-locking ties per se constitute a well known type of article of which there are numerous representatives described in the patent literature, e.g., U.S. Pat. Nos. 2,979,794; 3,339,246; 3,368,247; 3,457,598; 3,486,201; 3,537,146; 3,452,321; 3,588,962; 3,627,300; 3,654,669; 3,660,869; 3,731,347; 3,766,608; 4,137,606; 4,183,119; 4,272,870; 4,470,173; and, 4,477,950 to mention just a few.

SUMMARY OF THE INVENTION

It is an object of the present invention to provide a device which facilitates the bundling of successively formed stacks of articles.

It is another object of this invention to provide a bundling device in combination with a receptacle in which waste paper is received, accumulated into a stack, securely bundled into a unit and then removed therefrom to make room for the accumulation of another stack of waste paper to be bundled.

In keeping with these and the other objects of the invention, a bundling device is provided which comprises:

(a) a quantity of serially dispensable, flexible, elongated ties of a length sufficient to encompass a stack of articles to be bundled; and, (b) means for maintaining the ties in a predetermined position relative to said stack of articles which is to be formed thereon.

In a preferred embodiment of this invention, the foregoing bundling device is combined with an article-receiving receptacle having a base and front, rear and side panels and having dimensions sufficient to accommodate a stack of articles to be formed and bundled therein. The bundling device is placed within the receptacle and is generally positioned at about the geometric center of the latter's base with the terminal portions of the ties extending over the upper edge of the receptacle and being held in place against the exterior surfaces of the panels. While the ties can simple consist of string, rope, cord, wire, etc. they are preferably provided with an interengaging, self-locking feature which can be used to bundle stacks of varying heights. Where a single bundling device is employed it will usually be positioned upon the base of the receptacle to approximately coincide with the geometric center of the stack of articles to be formed thereon. When a sufficient number of articles has accumulated to form a stack of desired height, the ends of an individual tie are interengaged securely about the stack to form a bundled unit which is then removed from the receptacle to make way for the accumulation and bundling of another stack of articles. As successive stacks of articles are formed, bundled and removed from the receptacle, the supply of ties dwindles and is eventually exhausted. Whatever remains of the bundling device at this point, if anything, can then be discarded and a new bundling device with its fresh supply of serially dispensable ties can be positioned within the receptacle in place of the old one.

The simplicity of the foregoing bundling device lends it to being fabricated from readily available, low cost materials employing known and conventional manufacturing techniques. The device can be profitably sold at a price which will encourage its widespread acceptance and use by the general public with consequent benefits to the environment and the economy as noted above. Schools and charities wishing to raise funds through the sale of recyclable waste paper can promote the success of these efforts through wide distribution of the inexpensive bundling device of this invention, with the sponsoring organizations' logos prominently displayed on the waste paper-receiving receptacle optionally associated with the device.

BRIEF DESCRIPTION OF THE DRAWINGS

Other aspects of the invention will become apparent after considering several illustrative embodiments taken in conjunction with the drawings in which:

FIG. 1 is a perspective view of a combined bundling device and waste paper-receiving receptacle in accordance with the invention with a portion of the front and side panels cut away to reveal the arrangement of the interiorly disposed parts of the bundling device;

FIG. 2 is a perspective view of a stack of waste paper which has been formed and bundled into a conveniently disposable unit employing the combined bundling device and receptacle of FIG. 1;

FIG. 7 is a plan view of another embodiment of the bundling device herein in the form of a side-by-side gang of individually strippable ties of the preferred type shown in FIG. 6;

FIG. 8 is a perspective view of another form of the bundling device herein with a vertically arranged stack of tie gangs similar to the type illustrated in FIG. 7 shown in phantom;

FIG. 11 is a perspective view of a waste paperreceiving receptacle featuring a hinged lid;

FIGS. 12 and 13 are detailed perspective views of other types of tie holders which can be used with the combined bundling device and waste paper-receiving receptacle of FIG. 1; and, FIG. 14 is a perspective, partially cut-away, view of another embodiment of waste paper-receiving receptacle according to this invention wherein a supply of bundling ties are secured directly to the base panel of the receptacle.

DESCRIPTION OF THE PREFERRED EMBODIMENTS

Figure 3:
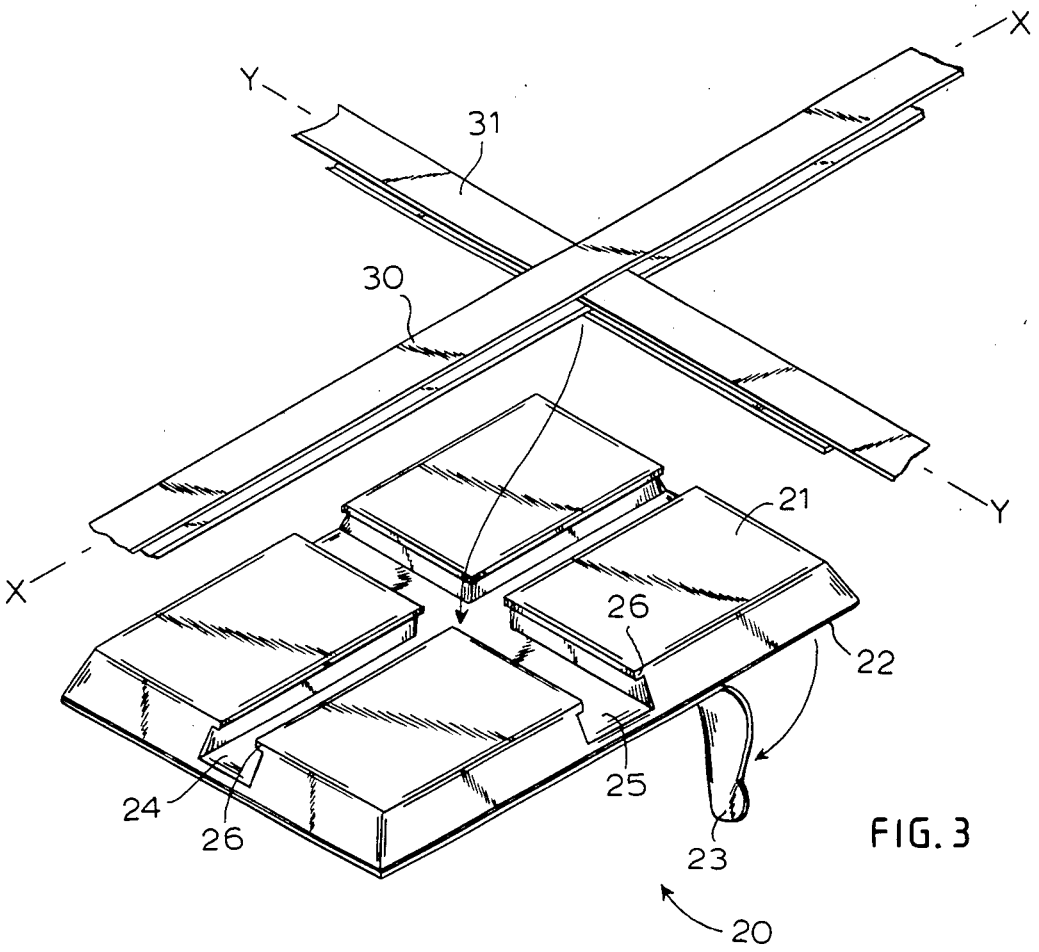
FIG. 3 is a detailed exploded perspective view of one embodiment of the bundling device shown generally in FIG. 1.

Turning to the drawings, FIG. 1 shows an open-top waste paper-receiving receptacle 10 possessing side panels 11 and 12, front and rear panels 13 and 14, base 15 and open edge 16. The dimensions of the receptacle can vary widely depending on the dimensions of the stack of waste paper (or other articles) to be formed therein; in general, receptacle dimensions of about eighteen to twenty inches length, twelve to fourteen inches width and six to fifteen inches height are entirely suitable for a tabloid-sized waste paper stack weighing up to fifty lbs. or so.

Since receptacle 10 will not be subjected to any significant mechanical stress during use, it need not be of particularly heavy construction. The receptacle can be of folding or collapsible design, especially where it is desired to market the combined bundling device and receptacle as a single unit. The principle function of receptacle 10 is to serve as a support for holders 40 engaging the terminal portions of serially dispensable elongated ties 30 and 30' as will be explained below; however, since holders 40 are not essential to the effective operation of bundling device 20, receptacle 10 can be dispensed with altogether. As an incidental or secondary function, receptacle 10 serves to disguise its function, i.e., as a storage place for refuse, and to this end, can be provided with a decorative exterior to enhance its aesthetic appearance.

Receptacle 10 can be manufactured from any suitable material, e.g., corrugated paperboard, plastic, aluminum, steel, wood, pressboard, composite, etc. Corrugated paperboard is especially advantageous as it is inexpensive, reasonably durable and can be provided in a variety of collapsible configurations with the bundling device fully or partially installed therein. A used corrugated paperboard carton of appropriate dimensions can also be used as the waste-paper receiving receptacle herein. As shown in FIG. 11 receptacle 10 can be provided with a separate cover or hinged lid 17 and, optionally, a slot 18 at the upper end of front panel 13 through which discarded papers, magazines, etc., can be introduced into the receptacle without disturbing the cover or lid.

Positioned at approximately the geometric center 'A' of base 15 is bundling device 20 which serves as a cartridge and anchoring means for a quantity of serially dispensable vertically stacked pairs of ties 30 and 30' which, respectively, extend the length and width of base 15 along perpendicularly bisecting central axes x and y, up each side panel 11 and 12 and front and rear panels 13 and 14 and whose terminal portions 31, 32, 31' and 32' are held in place along open edge 16 by identical clip-on holders 40.

Figure 6:
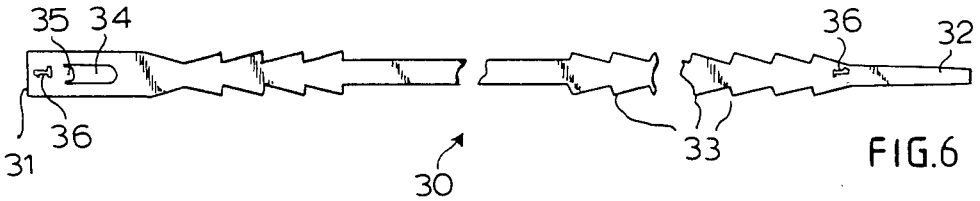
FIG. 6 is a plan view of a preferred type of tie for use in the bundling device of this invention.

In operation, waste paper is placed within receptacle 10 where it accumulates into a stack lying atop bundling device 20 approximately in line with geometric center 'A' of the receptacle. The terminal portions 31 and 32 of lengthwise strap 30 and the terminal portions 31' and 32' of crosswise strap 30' are brought together into self-locking relationship securely about the waste paper stack along axes x and y to form the bundle unit 50 shown in FIG. 2. Optionally, with suitable modification as shown in FIG. 6(*a*) more fully described below, bundling tie ends 31 and 31' can be made to interengage and form a handle which facilitates the removal of the bundle from receptacle 10 and make the bundle easier to carry.

In the detailed view of bundling tie cartridge 21 of bundling device 20 shown in FIG. 3, a peelable strip 22 when pulled away by tab member 23 exposes an adhesive which permits the cartridge to be secured in a fixed position on a surface, e.g., the center of bottom 15 of receptacle 10 shown in FIG. 1, but which also permits the cartridge to be readily removed therefrom once the supply of tie pairs is spent. Numerous types of adhesives are available for this purpose, e.g., many of the ethylene-vinyl acetate copolymer and ethylene-vinyl acetate-vinyl alcohol terpolymer-containing adhesive compositions known in the art. Where it is intended to position cartridge 21 within the base of a corrugated paperboard carton serving as receptacle 10, instead of using an adhesive, the underside of the cartridge can possess a number of projections which are designed to penetrate the corrugated surface providing a relatively firm means of attachment thereto. Cartridge 21, which can be formed from plastic or other suitable material with polyethylene or similar resin being preferred largely for reasons of economy, is provided with slots or channels 24 and 25 extending its length and width in a cruciform pattern. The upper edges of channels 24 and 25 assume the shape of lips 26 to better retain the tie pairs therein until such time as a bundle unit is removed from its superimposed position on the cartridge in which case the uppermost pair of ties will be removed to reveal the next set of ties. In the embodiment shown, tie 30 running lengthwise, or along the x axis, overlaps tie 31 running crosswise, or along the y axis, to form a tie pair, said pair together with the successive pairs of ties forming a serially dispensable vertical stack of such ties the central or middle portion of which is inserted into channels 24 and 25 of cartridge 21 as indicated by the arrow. There can be up to a dozen or more pairs of such ties provided within a cartridge. Of course, when the original supply of ties is used up, the cartridge can continue to be used with a fresh supply of ties.

Figure 4:
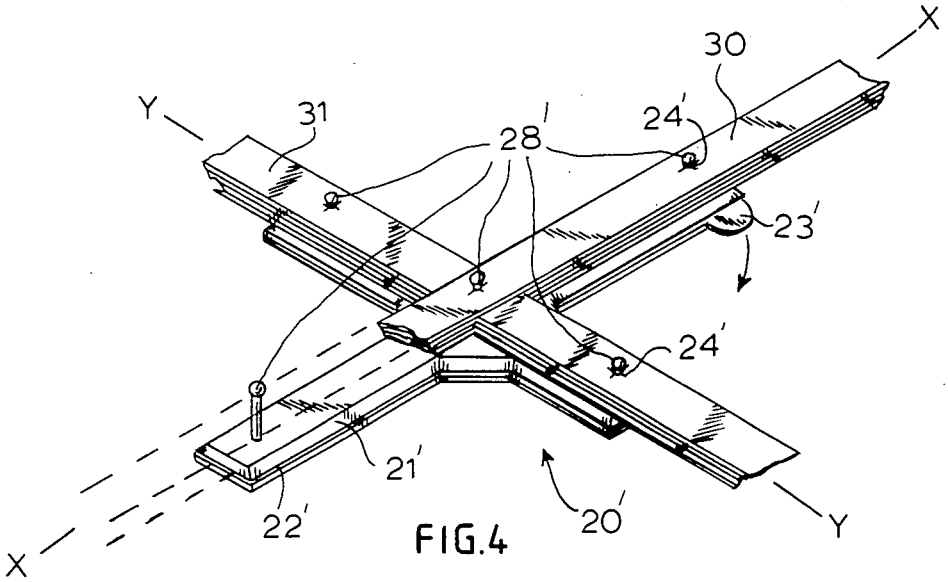
FIG. 4 is a perspective view of another embodiment of a bundling device in accordance with the invention which can be used in a waste paper-receiving receptacle as in Figure 1.

In an alternative embodiment of bundling device 20' shown in FIG. 4, cruciform base 21' possesses a peelable protective strip 22' having tab 23' to facilitate its removal. Strip 22 covers a layer of adhesive until such time as base 21' is to be fixed in place. The middle portion of a stack of tie strips 30 and 31 extending along the x and y axes, respectively, is held in place on base 21' by being impaled upon retaining studs 28' which project through corresponding apertures 24' defined within the ties. Apertures 24' possess small radial cuts to facilitate placement and removal of the tie strips upon base 21'.

Figure 5:
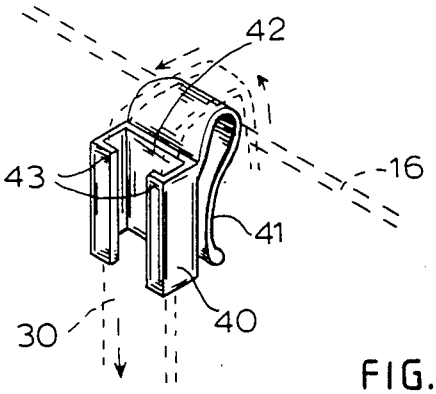
FIG. 5 is a detailed perspective view of the tie holder shown generally in FIG. 1.

In the enlarged view of tie holder 40 of FIG. 1 shown in FIG. 5, a clip 41 which can be integral with the holder is provided to permit a secure engagement of the holder with the upper edge 16 (indicated in phantom) of receptacle 10. Tie holder 40 can be formed from any suitable material, a plastic such as polyethylene being preferred mainly for reasons of cost. The terminal portion of a tie 30 (shown in phantom) is held within channel 42 by lip members 43. Holder 40 is preferably oriented with channel 42 facing away from the interior of receptacle 10. As shown in FIG. 12, in place of clip 41, the rear surface of holder 40 can be provided with an adhesive and peelable strip cover 44 which functions in the same manner as adhesive and peelable strip 22 of cartridge 21 shown in Figure 3. In this way, holder 40 need not be confined to the upper edge 16 of receptacle 10 but can be positioned anywhere on the interior and/or exterior surface of the various panels of the receptacle as desired. As shown in FIG. 13, when receptacle 10 of FIG. 1 is a corrugated paperboard carton, the rear surface of holder 40 can possess a number of projections 45 providing engagement with the wall of the carton as in the alternative embodiment of cartridge 21 described above.

Figure 6A:
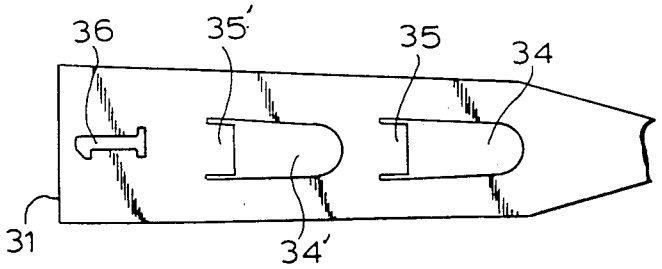
FIG. 6*a* shows a portion of the first end of the tie of FIG. 6 modified in a manner permitting its interengagement with the leader end of another tie to form a handle therewith.

FIG. 6 is illustrative of one type of tie, indicated generally at 30, which is especially useful in the practice of the present invention. This type of tie which possesses a self-locking feature is more fully described in U.S. Pat. No. 4,447,950, the contents of which are incorporated by reference herein. The tie comprises a flexible, elongated strip, preferably fabricated from a plastic such as polyethylene, polypropylene, etc., of suitable length, e.g., from about 60 to about 90 inches when used lengthwise (i.e., along axis x) and from about 40 to about 70 inches when used crosswise (i.e., along axis y), in bundling a stack of waster paper. The tie possesses a first end 31 and a leader end 32, a series of projections 33 which are roughly arrowhead in shape, an aperture 34 defined within first end 31 and a locking tab 35 extending a short distance into the aperture. When, in bundling a stack of articles, e.g., waste paper, leader end 32 is drawn around the stack and through aperture 34 (through which it can move freely in but one direction due to the retaining effect of arrowhead-like projections 33), it interengages first end 31 in self-locking relationship therewith provide a bundle unit. If desired, numbered cut-outs 36 or other form of labeling can be provided to facilitate correlation of first end 31 with leader end 32 of the same strip. In a modification of first end 31 of tie 30 shown in FIG. 6*a*, a second aperture 34' with locking tab 35' is provided to engage leader end 32 of another tie and form a handle 33 therewith as shown in FIG. 2.

In the simplified version of the bundling device of this invention shown in FIG. 7 which is especially suitable for use in combination with an article-receiving receptacle as shown in FIG. 1, a gang 60 of the type of tie 30 illustrated in FIG. 6 and which can be made by the method of U.S. Pat. No. 3,780,921, the contents of which are incorporated by reference herein, is provided at its middle, and optionally, at its terminal, portions with zones of adhesive covered by peelable protective strips 62, 63 and 63', respectively, together with tabs to facilitate their removal. Upon removal of the protective strips, a single gang of bundling ties can be fixed in position in the center of a receptacle, with the terminal portions 38 and 38' being fixed to the upper edges of the sides thereof. Alternatively, and for a more attractive arrangement, a zone of adhesive can be optionally provided upon the surface of the terminal portions of the gang opposite to that shown so that the portions of the ties extending over the edge of the receptacle can be held in place on the exterior surfaces of the receptacle.

In the bundling device 20'' of FIG. 8, a vertical stack of tie gangs as illustrated in FIG. 7 (but not having the adhesive zone(s) of the latter) is indicated in phantom as being held in place on rectangular base 21'' by means of retaining studs 28'' extending upwardly through apertures 24'' defined within each individual tie making up the gang. Base 21'' is provided with peelable protective strip 22'' and tab 23'' to cover a layer of adhesive until the bundling device is about to be fixed in place.

Figure 9:
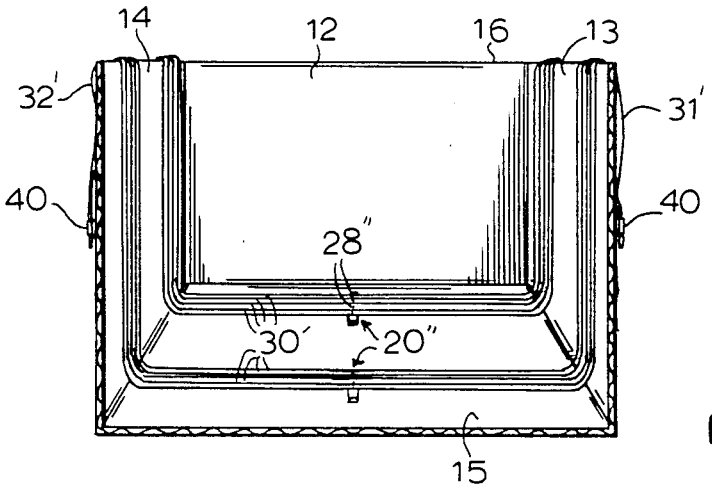
FIG. 9 is a perspective view of an open-top waste paper-receiving receptacle with a side panel removed to reveal the arrangement of two bundling devices in accordance with FIG. 8.
Figure 10:
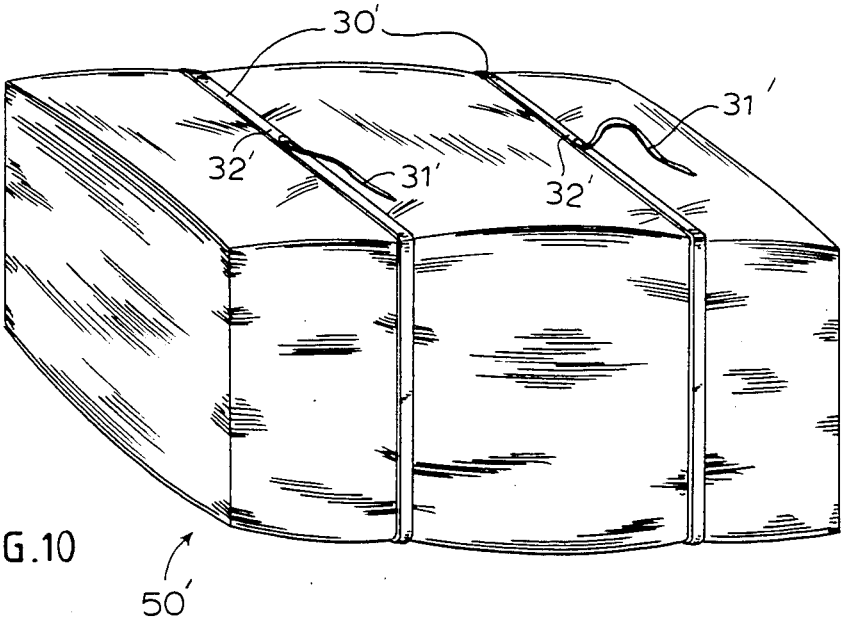
FIG. 10 is a perspective view of a stack of waste paper which has been formed and bundled into a conveniently disposable unit employing the combined bundling device and receptacle of FIG. 9.

As shown in FIG. 9, two bundling devices 20'' as illustrated in FIG. 8 are positioned some distance apart from each other on base 15 of a corrugated paperboard carton with each terminal portion 31' and 32' of the gangs 30'' being held in place by holders 40 adhesively fixed to the exterior sides of panels 13 and 14 of the carton. Holders 40 are preferably provided with retaining studs much like studs 28'' holding the tie gangs in place on the base of the carton. Employing this arrangement, the waste-paper bundle unit 50' shown in FIG. 10 is obtained.

For a still more simplified version of a bundling device in accordance with this invention, serially dispensible lengths of string, rope, cord, wire, etc., functioning as ties and optionally labeled to permit easier identification of the terminal portions of the same tie are individually secured to a base member provided with an adherent surface as previously described. Staples or other known attachment means can be used to secure each tie in place on the base member. As shown in FIG. 14, where ties 30 are to be combined with an article-receiving receptacle, perferably a corrugated paperboard carton, they can be secured directly thereto employing staples 50 or other attachment means.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in appended claims.

What is claimed is:

1. A bundling device which comprises:

(a) an assembly of individual, serially dispensable, flexible, elongated ties having a first terminal portion at one end thereof, a middle portion, and a second terminal portion at the other end thereof and having a length sufficient to encompass a stack of articles to be bundled, said assembly of ties being adapted to accept successive stacks of articles formed directly thereon; and, (b) means for maintaining the assembly of ties in a predetermined position relative to a stack of articles directly thereon, said means comprising a cartridge having an upper side and an underside, said cartirdge having means on its upper side for retaining a quantity of said ties and surface engaging means associated with its underside for its attachment to a surface.

2. The bundling device of claim 1 wherein the first terminal portion of a tie cooperates with the second terminal portin of the same tie to provide self-locking interengagement therewith.

3. The bundling device of claim 2 wherein the first terminal portion and second terminal portion of each tie is labeled in such manner as to distinguish each tie from the other ties in the assembly and facilitate self-locking interengagement of the first terminal portion and second terminal portion of the same tie.

4. The bundling device of claim 2 possessing an aperture defined within the first terminal portion of a tie and a series of arrowhead-like projections formed at the second terminal portion of the tie, said arrowhead-like projections defining a leader adapted to be inserted in the apertured first terminal portion to provide self-locking interengagement of the first terminal portion of the tie and second terminal portion of the same tie.

5. The bundling device of claim 4 wherein the ties are arranged in the form of a gang with each individual tie in the gang being serially removable from the other ties in the gang.

6. The bundling device of claim 5 wherein the arrangement of ties in the gang is such that the first terminal portion of one tie is parallel to the second terminal portion of an adjacent tie while the second terminal portion of the former is parallel to the first terminal portion of the latter.

7. The bundling device of claim 5 wherein the means for maintaining the assembly of ties comprising the gang in a predetermined position relative to a stack of articles formed thereon comprises a cartridge having an upper side and an underside and studs projecting upwardly from the upper side for piercing, retaining engagement of the middle portion of each tie in the gang upon the upper side of the cartridge, the underside of the cartridge possessing means for its attachment to a surface.

8. The bundling device of claim 7 wherein a vertically stacked assembly of gangs of ties are retained upon the upper side of the cartridge.

9. The bundling device of claim 2 wherein the ties are provided in pairs with a pair of ties comprising a tie extending lengthwise overlapping a tie extending crosswise in a cruciform configuration.

10. The bundling device of claim 9 wherein the first terminal portion of one of the ties in the pair cooperates with the second terminal portion of the other tie in the pair to form a handle therewith.

11. The bundling device of claim 1 wherein the first terminal portion and second terminal portion of each tie is labeled in such manner as to distinguish each tie from the other ties in the assembly and facilitate self-locking interengagement of the first terminal portion and second terminal portion of the same tie.

12. The bundling device of claim 1 wherein the underside of the cartridge possesses an adhesive for effecting its attachment to a surface.

13. The bundling device of claim 1 wherein the cartridge possesses a channel of sufficient depth and width defined within its upper side as to accommodate the middle portion of an assembly of vertically stacked bundling ties inserted therein.

14. The bundling device of claim 1 wherein the ties are provided in pairs with a pair of ties comprising a tie extending lengthwise overlapping a tie extending crosswise, the cartridge possessing a cruciform configuration of channels defined within its upper side of sufficient depth and width as to accommodate the middle portion of an assembly of vertically stacked pairs of bundling ties inserted therein.

15. The bundling device of claim 1 wherein the cartridge possesses at least one stud projecting upwardly from its upper side for piercing, retaining engagement of the middle portion of an assembly of vertically stacked bundling ties upon the upper side of the cartridge.

16. The bundling device of claim 1 wherein the ties are provided in pairs with a pair of ties comprising a tie extending lengthwise overlapping a tie extending crosswise in a cruciform configuration, the cartridge possessing a corresponding cruciform configuration and possessing at least one stud projecting upwardly from its upper side for piercing, retaining engagement of the middle portion of an assembly of vertically stacked pairs of bundling ties upon the upper side of the cartridge.

17. A bundling device which comprises:

(a) an assembly of individual, serially dispensable, flexible, elongated ties having a first terminal portion at one end thereof, a middle portion, and a second terminal portion at the other end thereof and having a length sufficient to encompass a stack of generally flat articles to be bundled, said assembly of ties being adapted to accept successive stacks of said articles formed directly thereon;

(b) means for maintaining the assembly of ties in a predetermined position relative to a stack of said articles formed directly thereon; and, (c) an article-receiving receptacle having a generally flat base and walls cooperating therewith to provide an enclosure with the means for maintaining the assembly of ties in a predetermined position relative to said stack of generally flat articles formed directly thereon being attached to or integral with the base of the receptacle and in same planethereof at a preselected site thereon.

18. The bundling device of claim 17 wherein the first terminal portion of a tie (a) cooperates with the second terminal portion of the same tie to provide self-locking interengagement therewith.

19. The bundling device of claim 18 wherein the first terminal portion and second terminal portion of each tie is labeled in such manner as to distinguish each tie from the other ties in the assembly and facilitate self-locking interengagement of the first terminal portion and second terminal portion of the same tie.

20. The bundling device of claim 18 possessing an aperture defined within the first terminal portion of a tie and a series of arrowhead-like projections formed at the second terminal portion of the tie, said arrowhead-like projections defining a leader adapted to be inserted in the apertured first terminal portion to provide self-locking interengagement of the first terminal portion of the tie and second terminal portion of the same tie.

21. The bundling device of claim 20 wherein the ties are arranged in the form of a gang with each individual tie in the gang being serially removable from the other ties in the gang.

22. The bundling device of claim 21 wherein the arrangement of ties in the gang is such that the first terminal portion of one tie is parallel to the second terminal portion of an adjacent tie while the second terminal portion of the former is parallel to the first terminal portion of the latter.

23. The bundling device of claim 21 wherein the means for maintaining the assembly of ties comprising the gang in a predetermined position relative to a stack of articles formed thereon comprises a cartridge having an upper side and an underside and studs projecting upwardly from the upper side for piercing, retaining engagement of the middle portion of each tie in the gang upon the upper side of the cartridge, the underside of the cartridge possessing means for its attachment to the base of the receptacle.

24. The bundling device of claim 23 wherein a vertically stacked assembly of gangs of ties are retained upon the upper side of the cartridge.

25. The bundling device of claim 21 wherein at least two gangs are positioned at preselected sites on the base of the receptacle with one gang being parallel to the other gang.

26. The bundling device of claim 25 wherein at least two vertically stacked assembly of gangs are positioned at preselected sites on the base of the receptacle with one stack of gangs being parallel to the other stack of gangs

27. The bundling device of claim 26 wherein the means for maintaining the vertically stacked assembly of gangs of ties in a predetermined position relative to a stack of articles formed thereon comprises a cartridge having an upper side and an underside and studs projecting upwardly from the upper side for piercing, retaining engagement of the middle portion of each tie of each gang in the stack upon the upper surface of the cartridge, the underside of the cartridge possessing means for its attachment to the base of the receptacle.

28. The bundling device of claim 25 wherein the middle portion of each gang is provided with adhesive to effect is attachment to the base of the receptacle and the terminal portions of each gang are provided with adhesive to effect their attachment to the walls of the receptacle.

29. The bundling device of claim 21 wherein the middle portion of the gang is provided with adhesive to effect its attachment to the base of the receptacle and the terminal portions of the gang are provided with adhesive to effect their attachment to the walls of the receptacle.

30. The bundling device of claim 18 wherein the ties are provided in pairs with a pair of ties comprising a tie extending lengthwise overlapping a tie extending crosswise in a cruciform configuration.

31. The bundling device of claim 30 wherein the first terminal portion of one of the ties in the pair cooperates with the second terminal portion of the other tie in the pair to form a handle therewith.

32. The bundling device of claim 18 wherein the means for maintaining the assembly of ties in a predetermined position relative to a stack of articles formed thereon comprises a cartridge having an upper side and an underside, said cartridge having means upon its upper side for retaining a quantity of bundling ties and means on its underside for its attachment to the base of the receptacle.

33. The bundling device of claim 32 wherein the underside of the cartridge possesses an adhesive for effecting its attachment to the base of the receptacle.

34. The bundling device of claim 32 wherein the cartridge possesses a channel of sufficient depth and width defined within its upper side as to accommodate the middle portion of an assembly of vertically stacked bundling ties inserted therein.

35. The bundling device of claim 32 wherein the ties are provided in pairs with a pair of ties comprising a tie extending lengthwise overlapping a tie extending crosswise, the cartridge possessing a cruciform configuration of channels defined within its upper side of sufficient depth and width as to accommodate the middle portion of an assembly of vertically stacked pairs of bundling ties inserted therein.

36. The bundling device of claim 32 wherein the cartridge possesses at least one stud projecting upwardly from its upper side for piercing, retaining engagement of the middle portion of an assembly of vertically stacked bundling ties upon the upper side of the cartridge.

37. The bundling device of claim 32 wherein the ties are provided in pairs with a pair of ties comprising a tie extending lengthwise overlapping a tie extending crosswise in a cruciform configuration, the cartridge possessing a corresponding cruciform configuration and possessing at least one stud projecting upwardly from its upper side for piercing, retaining engagement of the middle portion of an assembly of vertically stacked pairs of bundling ties upon the upper side of the cartridge.

38. The bundling device of claim 17 wherein the first terminal portion and second terminal portion of each tie is labeled in such manner as to distinguish each tie from the other ties in the assembly and facilitate self-locking interengagement of the first terminal portion and second terminal portion of the same tie.

39. The bundling device of claim 17 wherein the receptacle is fabricated from corrugated paperboard, plastic, metal, wood, pressboard or composite.

40. The bundling device of claim 39 wherein the receptacle is fabricated from corrugated paperboard and the channeled holder possesses projections for piercing engagement with a wall of the receptacle.

41. The bundling device of claim 17 further comprising:

(d) means for attaching the terminal portions of the ties to preselected sites on the walls of the receptacle.

42. The bundling device of claim 41 wherein the means for attaching the terminal portions of the ties to the walls of the receptacle comprises a channeled holder.

43. The bundling device of claim 40 wherein the channeled holder possesses a clip for securing the holder to an upper edge of a wall of the receptacle.

44. The bundling device of claim 42 wherein the channeled holder possesses an adhesive for securing the holder to a wall of the receptacle.

45. The bundling device of claim 17 possessing a lid.

46. The bundling device of claim 45 possessing a slot defined in the wall of the receptacle adapted to receive articles to be bundled.

47. The bundling device of claim 17 wherein the ties are individually secured directly to the base of the receptacle.

* * * * *